US007566840B2

(12) United States Patent
Sudhakar et al.

(10) Patent No.: US 7,566,840 B2
(45) Date of Patent: Jul. 28, 2009

(54) CONTACT ARM MECHANISM FOR CIRCUIT BREAKER

(75) Inventors: Sapuram Sudhakar, Hyderabad (IN); Deepak Raorane, Secunderabad (IN); Arvind Pai, Udupi (IN); Kapil Bavikar, Hyderabad (IN)

(73) Assignee: General Electric Company, Schenectady, NY (US)

( * ) Notice: Subject to any disclaimer, the term of this patent is extended or adjusted under 35 U.S.C. 154(b) by 140 days.

(21) Appl. No.: 11/867,352

(22) Filed: Oct. 4, 2007

(65) Prior Publication Data

US 2009/0091407 A1 Apr. 9, 2009

(51) Int. Cl.
*H01H 33/00* (2006.01)

(52) U.S. Cl. ..... 200/244; 218/154

(58) Field of Classification Search ..... 200/17 R, 200/400, 401, 244; 218/22, 30, 31, 32, 146, 218/152, 153, 154; 335/6–16, 167–174, 335/147, 195
See application file for complete search history.

(56) References Cited

U.S. PATENT DOCUMENTS 4,761,524 A * 8/1988 Golowash ..... 200/400
5,101,675 A * 4/1992 Lauterwald ..... 74/2
5,195,632 A * 3/1993 Lauterwald ..... 200/400
6,018,284 A 1/2000 Rival et al.
6,262,642 B1 * 7/2001 Bauer ..... 335/16
6,326,868 B1 * 12/2001 Kranz et al. ..... 335/8
6,376,788 B1 * 4/2002 Jones et al. ..... 200/244
6,437,670 B1 8/2002 Castonguay et al.
6,507,256 B1 1/2003 Castonguay et al.
6,586,693 B2 * 7/2003 Castonguay ..... 200/318
6,819,205 B2 11/2004 Bach et al.
6,940,032 B2 * 9/2005 Sirajtheen et al. ..... 200/400
6,977,568 B1 12/2005 Rakus et al.
7,105,764 B2 9/2006 Rakus et al.
7,189,935 B1 * 3/2007 Hassan et al. ..... 200/244
7,397,008 B2 * 7/2008 Ahn et al. ..... 200/400

* cited by examiner

*Primary Examiner*—Michael A Friedhofer
(74) *Attorney, Agent, or Firm*—Cantor Colburn LLP

(57) ABSTRACT

A mechanism for a circuit breaker contact arm that allows current limiting by reducing the opening time is disclosed. A contact arm is coupled to a contact arm mechanism that includes a carrier coupled to a first pair of linkages. A second pair of linkages is coupled to the first pair of linkages. A second carrier coupled to the second pair of linkages attaches to the contact arm mechanism to a main circuit breaker mechanism through a lay shaft assembly. Upon the occurrence of an undesired electrical condition, the contact arm mechanism moves from a locked to an open position allowing the contact arm to blow open.

20 Claims, 9 Drawing Sheets

CONTACT ARM MECHANISM FOR CIRCUIT BREAKER

BACKGROUND OF THE INVENTION

The subject matter disclosed herein relates to a mechanism for a circuit breaker. In particular, the subject matter disclosed herein relates to a mechanism coupled to a contact arm to provide current limiting functionality by reducing the opening time.

Air circuit breakers are commonly used in electrical distribution systems. A typical air circuit breaker comprises an assembly of components for connecting an electrical power source to a consumer of electrical power called a load. The components are referred to as a main contact assembly. In this assembly, a main contact is typically either opened, interrupting a path for power to travel from the source to the load, or closed, providing a path for power to travel from the source to the load. In a particular type of circuit breaker, referred to as an air circuit breaker, the force necessary to open or close the main contact assembly is provided by an arrangement of compression springs. When the compression springs discharge, they exert a force that provides the energy needed to open or close the main contacts. Compression springs that provide a force to close the main contacts are often called closing springs. Compression springs that provide a force to open the main contacts are often referred to as contact springs.

The mechanism for controlling the compression springs comprises a configuration of mechanical linkages between a latching shaft and an actuation device. The actuation device may be manually or electrically operated. An electrically operated actuation device generally operates when a particular electrical condition is sensed, for example, over-current or short-circuit conditions. The actuation device within the circuit breaker typically imparts a force onto a linkage assembly. The linkage assembly then translates the force from the actuation device into a rotational force exerted on the latching shaft. The latching shaft then rotates. This rotation is translated through the mechanical linkages to unlatch or activate either the closing springs or the contact springs. There is typically a first latching shaft mechanically linked to the closing springs called the closing shaft. A second latching shaft is mechanically linked to the contact springs called the tripping shaft.

As each actuation device acts upon the latching shaft via a corresponding linkage assembly, the linkage assembly acts as a lever converting a linear force from the actuation device to a rotational force on the latching shaft. The time required for the actuation device to be electrically activated and initiate movement of the mechanism and the contact assembly can be lengthy. Where an undesirable electrical condition exists, this time period required to open the contact assembly may be longer than desired.

While existing circuit breakers are suitable for their intended purposes, there still remains a need for improvements particularly regarding the operation of the circuit breaker and the time required to open the contacts under high current and short circuit conditions.

SUMMARY OF THE INVENTION

A circuit breaker is disclosed having a contact structure movable between a closed and an open position. A first mechanism is operably coupled to the contact structure where the mechanism is movable between an open and a closed position. A second mechanism is operably coupled between the first mechanism and the contact structure. The second mechanism includes a first linkage pair having first and second links operably coupled to the contact structure. The second mechanism further includes a second linkage pair having third and fourth links operably coupled to the first mechanism. Finally, a first spring couples the first linkage pair and a second spring couples the second linkage pair.

A mechanism for a circuit breaker contact arm is also disclosed having a first carrier. The mechanism further includes a first pair of linkages coupled to each other by a first spring where each of the first pair of linkages is pivotally coupled to the first carrier. A second pair of linkages is coupled to each other by a second spring. Each of the second pair of linkages is pivotally coupled to the first pair of linkages. A second carrier is pivotally coupled to the second pair of linkages.

A multi-pole circuit breaker is also disclosed having a mechanism movable between a first and second position. The multi-pole circuit breaker further has a first and second contact arm with each of the contact arms being movable between a closed and a blown-open position. A first and second contact mechanisms is associated with one of the contact arm. Each contact mechanism operably couples the associated contact arm and the mechanism. Each of the contact mechanisms further includes a first carrier connected to the contact arm. A first pair of linkages is coupled to each other by a first spring and pivotally coupled to the first carrier. A second pair of linkages is coupled to each other by a second spring and is pivotally coupled to the first pair of linkages. Lastly, a second carrier is pivotally coupled to the second pair of linkages and is pivotally coupled to the mechanism.

BRIEF DESCRIPTION OF THE DRAWINGS

Referring now to the drawings, which are meant to be exemplary and not limiting, and wherein like elements are numbered alike.

DETAILED DESCRIPTION

Figure 1:
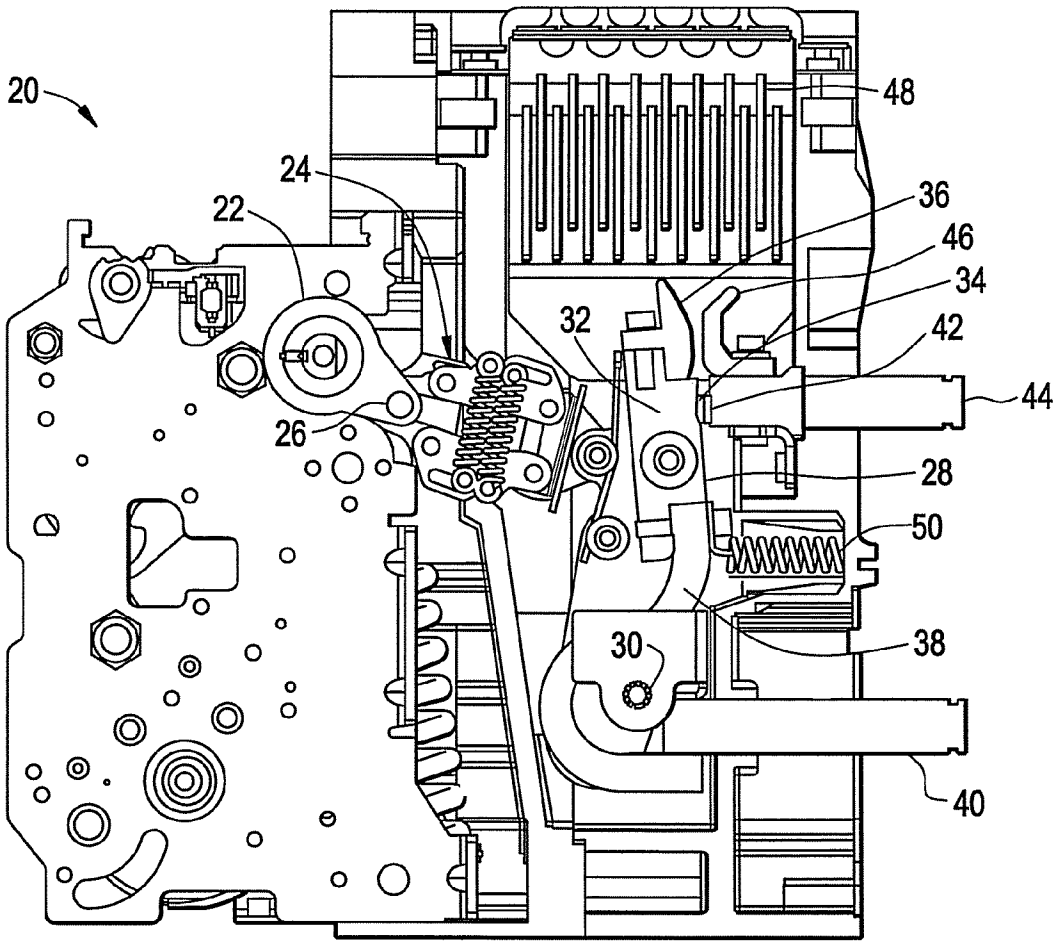
FIG. 1 is a side plan view illustration of a circuit breaker in the closed position in accordance with the exemplary embodiment.

FIG. 1 illustrates a circuit breaker 20 in the closed position. The circuit breaker 20 includes a main mechanism (not shown) that is coupled to a lay shaft assembly 22. The lay shaft assembly 22 rotates in response to the main mechanism being moved between an on and off position. The lay shaft assembly is coupled to a contact arm mechanism 24 through a pin 26. As will be described in more detail herein, the contact arm mechanism 24 as illustrated in FIG. 1 is in a locked position and transfers the energy from the main mechanism that is necessary to open and close a contact arm assembly 28. The contact arm assembly 28 is mounted in the circuit breaker 20 to pivot about a pin 30 to move between a closed, an open and a blown-open position.

It should be appreciated that the contact arm assembly 28 is illustrated in the exemplary embodiment as a single component. However, the contact arm 32 may be comprised of multiple contact arms each coupled to the contact arm mechanism 24. Further, the exemplary embodiment illustrates the circuit breaker 20 have a single contact arm or what is commonly referred to as a "pole." Each pole of a circuit breaker carries electrical current for a single electrical phase. In a "multi-pole" circuit breaker the circuit breaker will have several poles, typically three, each carrying a different phase of electricity through the circuit breaker 20. Each of the poles is individually connected to the lay shaft assembly 22 through a separate contact arm assembly 24.

The contact arm assembly 28 includes an arm 32 having a movable contact 34 and an arcing contact 36 mounted to one end. A flexible, electrically conductive strap 38, made from braided copper cable for example, is attached to the opposite end. The strap 38 electrically couples the contact arm 32 to a conductor 40 that allows electrical current to flow through the circuit breaker 20. The electrical current flows through the contact arm assembly 32 and exits via movable contact 34. The current then passes through stationary contact 42 and into conductor 44 where it is transmitted to the load. The contacts 34, 42 are typically made from a silver tungsten composite to minimize resistance. Another arcing contact 46 is mounted to the conductor 44. The arcing contacts 36, 46 assist the circuit breaker in moving any electrical arc formed when the contact arm is opened into an arc chute 48. A compression spring 50 is mounted to the circuit breaker 20 to exert a force on the bottom of the contact arm assembly 32 and assist with the opening of the contact arm.

Figure 2:
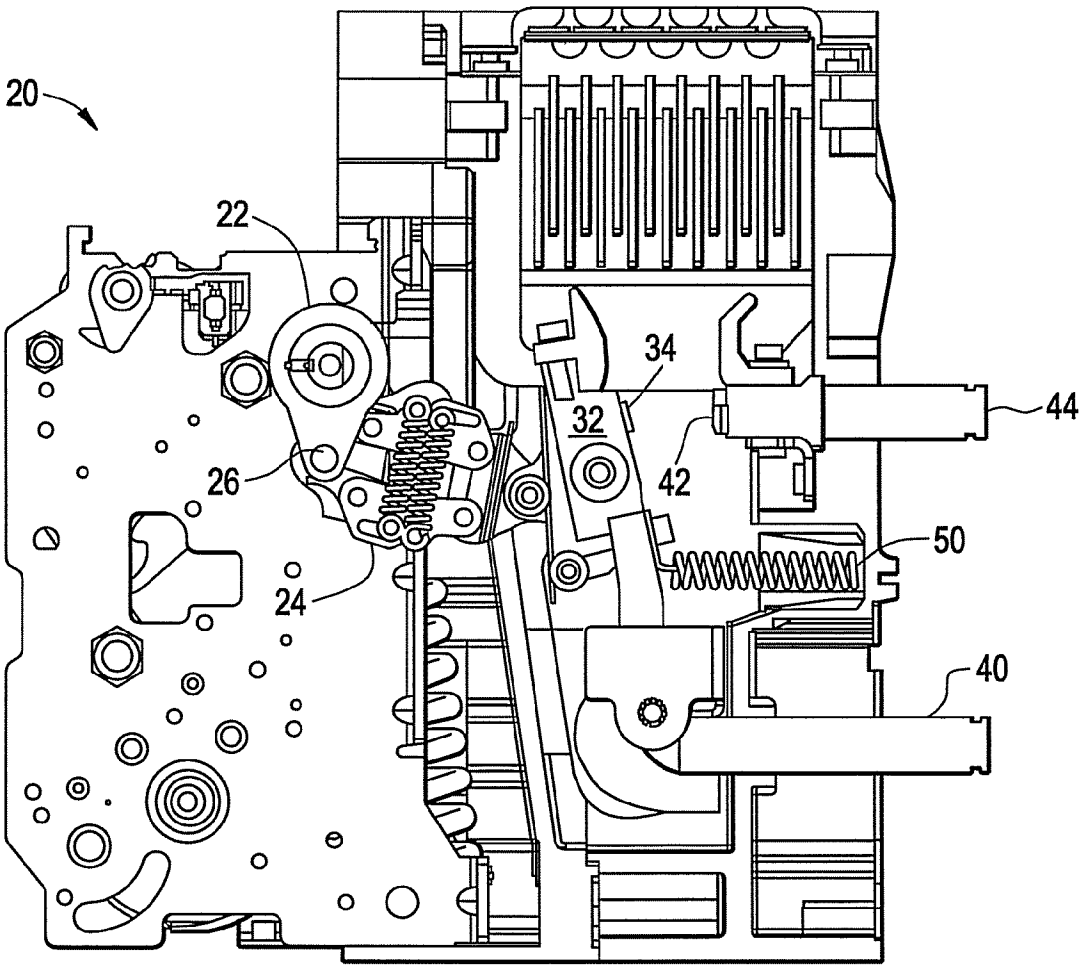
FIG. 2 is a side plan view illustration of the circuit breaker of FIG. 1 in the open position.

During normal operation of the circuit breaker 20, the operator may desire to remove electrical power from a circuit. To accomplish this, the main mechanism is activated, by an off push button for example, causing the lay shaft assembly 22 to rotate to an open position as illustrated in FIG. 2. The contact arm assembly 24 remains in a locked position. The rotational movement of the lay shaft assembly is translated into motion of the contact arm mechanism 24 causing the contact arm assembly 28 to rotate about pivot 30. This rotation by the contact arm assembly 28 results in the movable contact 34 separating from the stationary contact 42 and the halting of electrical current flow. To re-initiate flow of electrical power, the operator reactivates the main mechanism, by moving a closing push button for example, causing the lay shaft assembly 22 to rotate back to the position illustrated in FIG. 1.

Under certain circumstances, the load connected to conductor 44 may experience an undesired condition, such as a short-circuit for example. Under these conditions, the level of current flowing through the circuit breaker will increase dramatically. For example, under normal operating conditions, circuit breaker 20 may carry 400-5000 A of electricity at 690V. Under short circuit conditions, the current levels may exceed more than 100 kA depending upon the facility in which the circuit breaker 20 is installed. These high levels of current are undesirable and the operator will typically desire to limit the amount of current that flows through circuit breaker 20 under these conditions. During these conditions, due to the geometry of the current path through the circuit breaker 20, a large amount of magnetic force is generated between the contact arm assembly 28 and the conductor 44.

Figure 3:
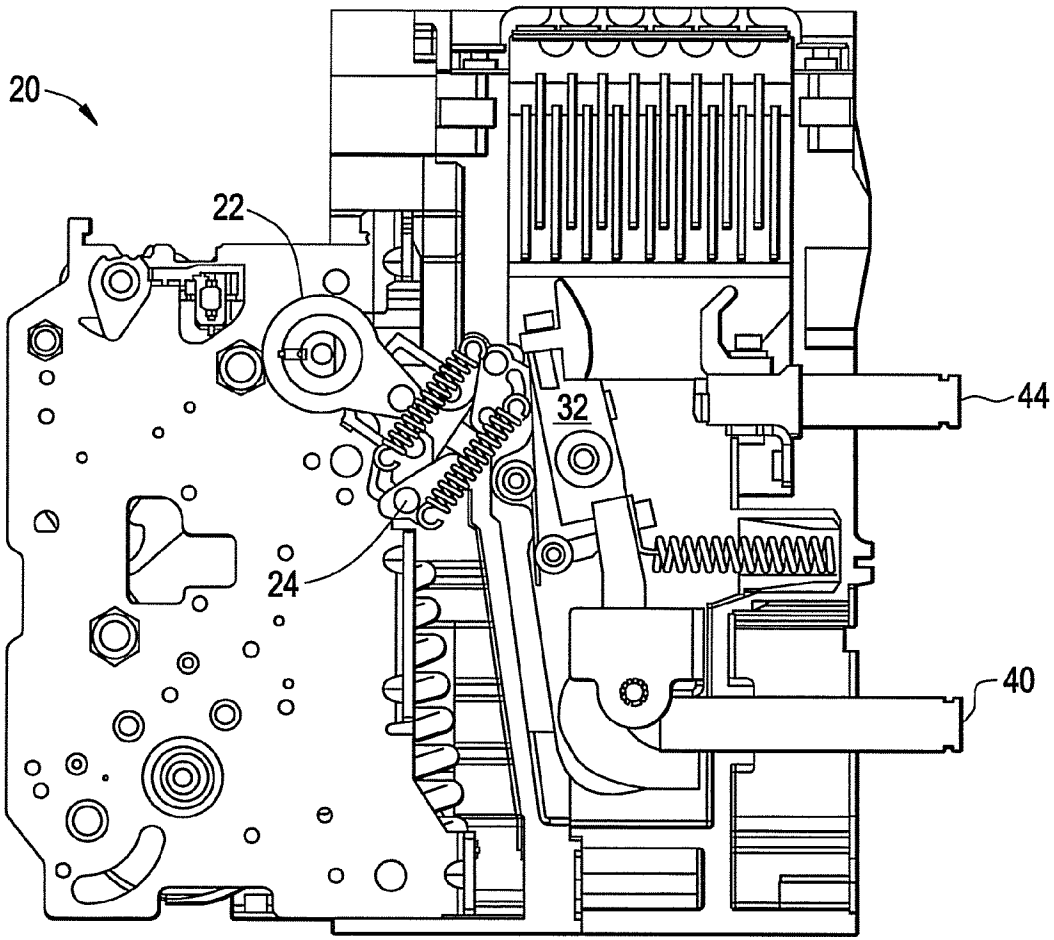
FIG. 3 is a side plan view illustration of the circuit breaker of FIG. 1 with the contact arm in a blown open position.

As illustrated in FIG. 3, the contact arm assembly 28 is arranged such that when the magnetic force between the conductor 44 and the contact arm assembly 28 reaches a predefined level the contact arm assembly starts to rotate independent from the main mechanism. For example, the contact arm assembly rotation may initiate at the magnetic force level corresponding to 25 kA-100 kA and more preferably 50 kA. The different thresholds at which contact arm assembly 28 blows open will depend on selectivity of the circuit breaker 20 with other downstream feeder breakers (not shown) and the threshold limits are adjustable by varying force exerted by springs 88 of contact arm mechanism 24. The contact arm mechanism 24 will move from a locked position shown in FIG. 1, FIG. 2 and FIG. 6 to an open position illustrated in FIG. 3. As the contact arm mechanism 24 activates, the contact arm assembly 32 is then rotated towards the open position. The rotation of the contact arm assembly 28 causes the movable contact 34 to separate from the stationary contact 42. Any electrical arc generated between the contacts 34, 42 is transferred via arcing contacts 36, 46 to the arc chute 48 where the energy from the electrical arc is dissipated.

Referring to FIGS. 4-9, the exemplary embodiment of the contact arm mechanism 24 will be described. The contact arm assembly 28 has a first carrier 52 that couples the contact arm mechanism 24 to the contact arm assembly 28. The contact arm mechanism 24 has a second carrier 78 that couples the contact arm mechanism to the lay shaft assembly 22. Plate 53, is attached to the carrier 52 to provide an electrical insulation barrier between the contact arm assembly 28 and the linkages in the contact arm mechanism 24. The carrier plates 52, 78 may be made from any suitable insulating material, phenolic resin or thermoset polyester plastic for example, a pair of links 54, 56 are coupled to the carrier 52 by pins 58. In the exemplary embodiment, the link 54 includes a slot 60 that captures a pin 62. The links may be made from any suitable material, including but not limited to steel, aluminum or plastic. A second pin 66 is coupled to the link 56. The pins 62, 66 capture an extension spring 64 to couple the links together. A stopper projection 68 on plate 55 between the pair of links 54, 56 and helps to achieve the contact arm configuration for a locked condition. The projection 68 helps in avoiding the collapsing of flexible links.

A second pair of links 70, 72 is coupled to the links 54, 56 by pins 74, 76 (FIG. 6) respectively. A slot 82 in link 72 captures pin 84 and another pin 86, attached to link 70, allows a second spring 88 to couple the links 70, 72. The links 70, 72 are coupled to a second carrier 78 by pins 80. The second carrier 78 may be made from any suitable material. In the exemplary embodiment, the second carrier 78 is made from the same insulating material same as carrier 52. A pin 26 couples the second carrier to the lay shaft assembly 22. Link 56 includes a surface 108 that contacts the pin 84 while the contact arm mechanism 24 is in the locked position. A pair of plate guides 92, 94 is coupled between pins 80, 58. Each plate guide 92, 94 includes a slot 96 that allows the plate guides 92, 94 to rotate as the contact arm mechanism 24 moves between a locked and open position.

A third pair, 98, 99 and fourth pair 100, 101 of links are arranged in an identical, but mirror, manner on the opposite sides of the carriers 52, 78. The linkage pairs are separated by the thickness of the body 108, 110 of the carriers 52, 78 respectively. Extension spring 102 couples the third linkage pair 98,99 and extension spring 104 couples the fourth linkage pair 100, 101. A second plate 106 is positioned between the third and fourth linkage pairs includes a projection similar to projection 68 to separate the links and maintain them in the correct position. The first pair of linkages 54, 56 and the third pair of linkages 98, 99 are coupled together by pins 62, 66 respectively. The second pair of linkages 70, 72 and the fourth pair of linkages 100, 101 is coupled together by pins 86, 84 respectively. It should be appreciated that each half of the contact arm mechanism assembly 24 is a mirror image of the other and that while the operation of the contact arm mechanism assembly 24 may be described herein with respect to one of the sides, first linkage pair 54, 56 and second linkage pair 70, 72 for example, the description is also describing the operation of the opposite side of contact arm mechanism 24.

Figure 4:
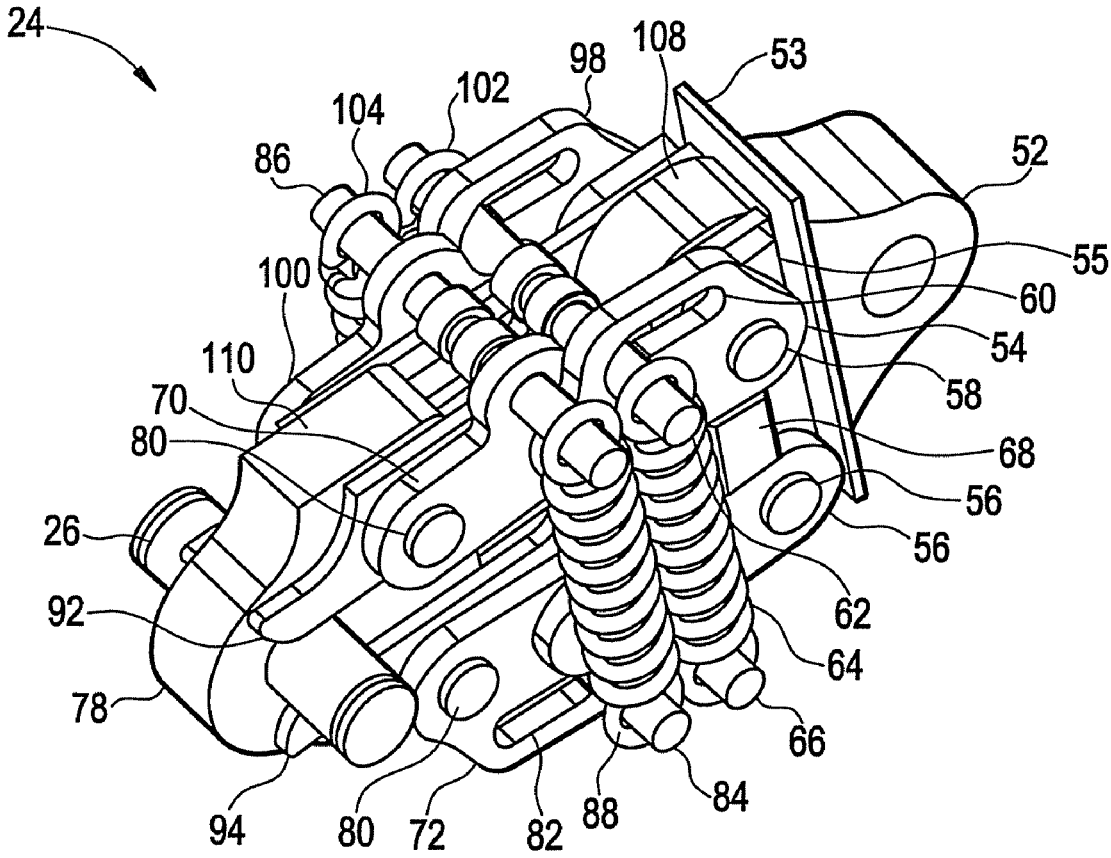
FIG. 4 is a perspective view illustration of the contact arm mechanism of FIG. 1.
Figure 5:
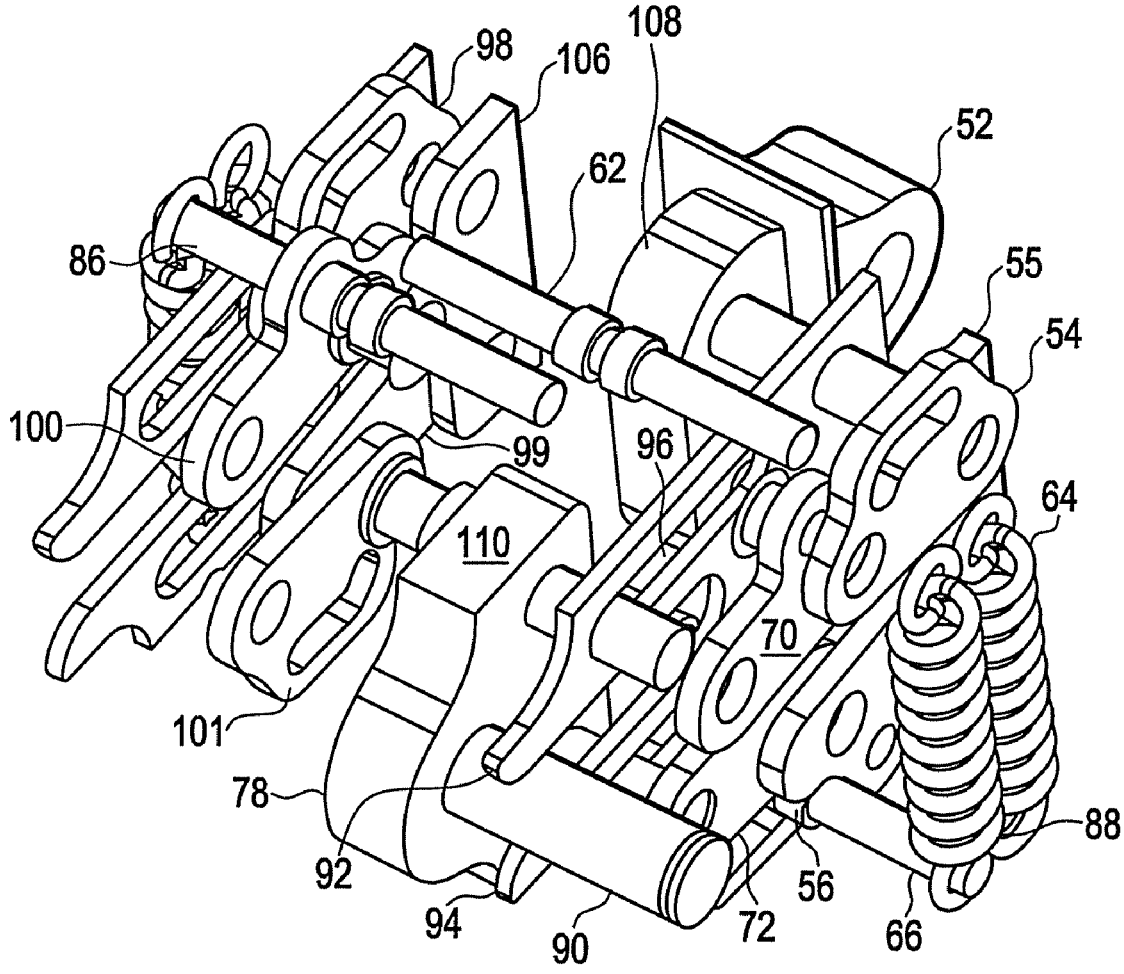
FIG. 5 is an exploded perspective view illustration of the contact arm mechanism of FIG. 4.
Figure 6:
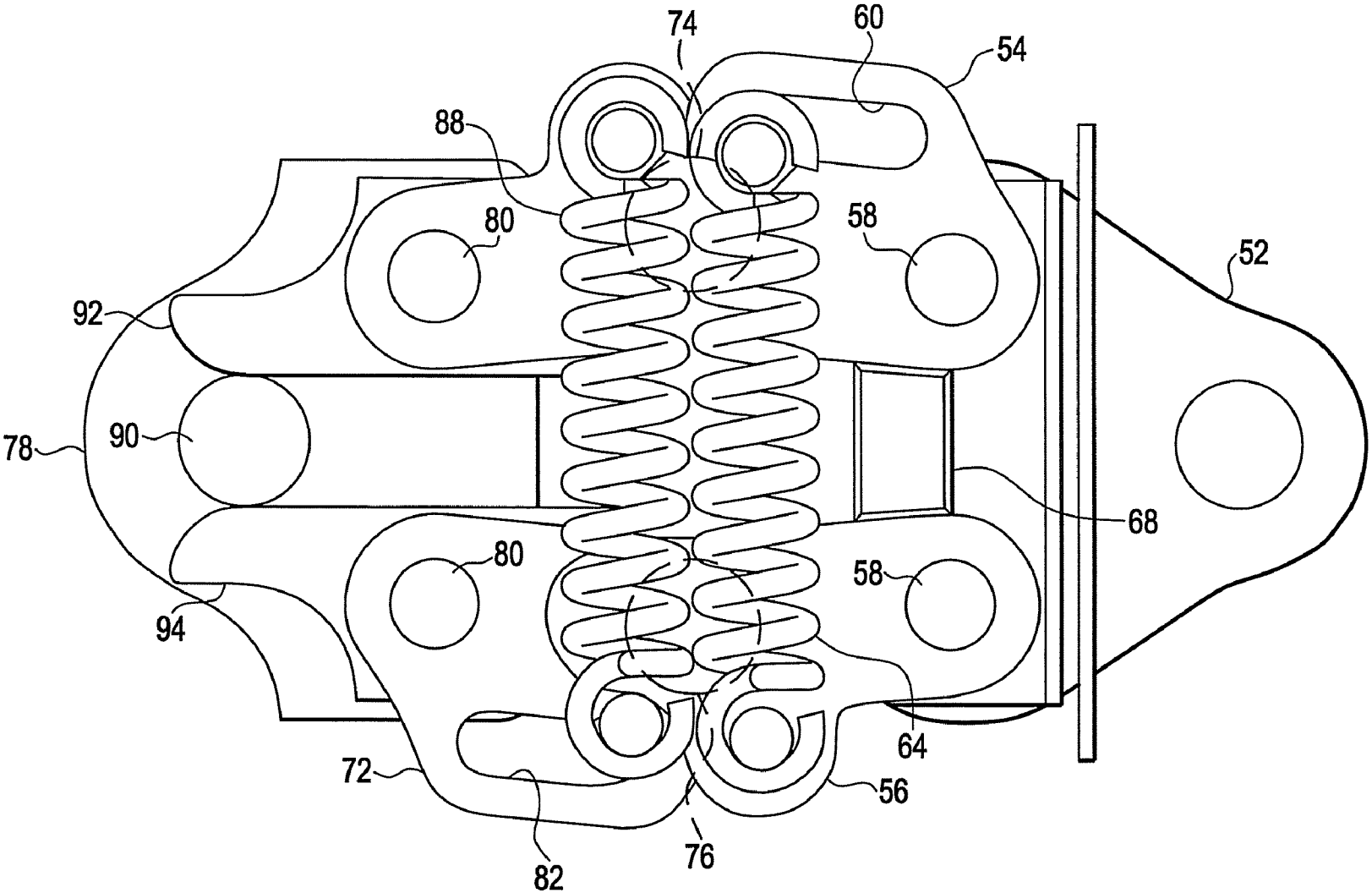
FIG. 6 is a side plan view illustration of the contact arm mechanism of FIG. 4.

During normal operation, the contact arm mechanism 24 is in a locked position, as illustrated in FIG. 4 and FIG. 6. While in the locked position, the contact arm mechanism 24 moves, more or less, as a single rigid linkage between the main mechanism and the contact arm assembly 32. This allows the main mechanism to open and close the contact arm assembly 32 without changing the position of the components in contact arm mechanism 24 relative to each other. However, during a short-circuit condition, as discussed above, the lay shaft assembly 22 remains in a closed position, while the magnetic force bias' the contact arm 32 towards the open position.

When the level of the current due to the short circuit condition is sufficiently high, 251 kA-100 kA for example, the magnetic force on the contact arm is sufficiently large to overcome the spring forces generated by springs 64, 88, 102, 104 causing the contact arm mechanism to move to the open position. For purposes of describing the movement of contact arm mechanism 24 from the locked to the open position, the movement of the links will be described with reference to FIGS. 7-9. It should be appreciated the some of the components have been removed from FIGS. 7-9 for clarity.

Figure 8:
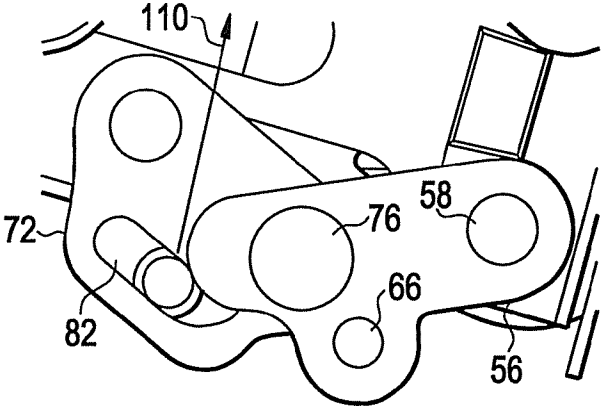
FIG. 8 is a partial plan view illustration of the contact arm mechanism of FIG. 4 in an intermediate position.
Figure 7:
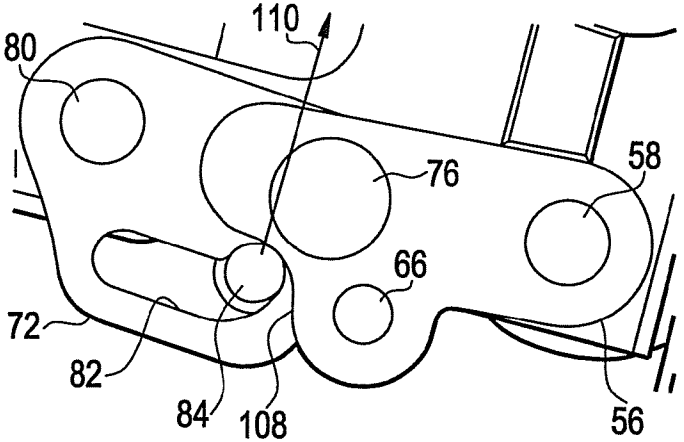
FIG. 7 is a partial plan view illustration of the contact arm mechanism of FIG. 4 in a locked position.
Figure 9:
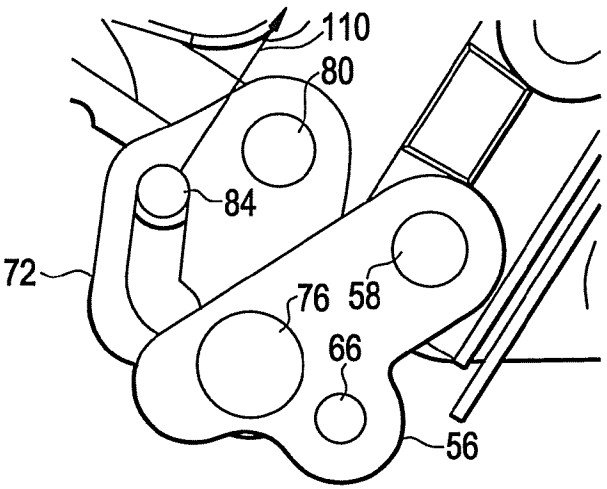
FIG. 9 is a partial plan view illustration of the contact arm mechanism of FIG. 4 in an open position.

As discussed above, the magnetic forces are transferred through the contact arm and carrier 52. This force causes the links 56, 72 to rotate, resulting in an increase of the force on surface 108 from pin 84. When the force is sufficiently large, the springs 88, 64 will extend and allow the pin 84 to slide within the slot 82 as shown in FIG. 8. The pin 84 will remain in contact with the link 56 as long as the spring force, represented by the arrow 110, remains between the center of pin 80 and pin 76. Once the line of force 110 moves beyond the center of pin 80 (commonly referred to as "over-centering"), the force from spring 88 causes the link 72 to rotate away so the pin 84 separates from the surface 108 allowing the pin 83 to slide to the end of slot 82. It should be appreciated that the same interactions described above with respect to links 56, 72 occur between links 54, 70, links 98, 100 and links 99, 101.

As the pins 62, 84 start to move within the link slots, the contact arm assembly 32 will start to rotate allowing the movable contact 34 to separate from the stationary contact 42. The contact arm assembly 32 will continue to open until the pins 62, 84 reach the ends of the link slots. This position, commonly known as the "blown-open" position, is illustrated in FIG. 3.

Allowing the contact arm assembly 32 to separate from the stationary contact 42 without the assistance of the main mechanism provide advantages in the operation of the circuit breaker 20. This opening operation ("blow-open operation") allows the minimum current through the circuit breaker for an existing fault level in the system, and thus the fault experienced by the protected load, to be limited since the contact arm mechanism 24 can react to the undesired electrical condition faster than the main mechanism. In the exemplary embodiment it is expected that the contract arm mechanism will allow the contact arm assembly 32 to separate in 8-10 milliseconds versus 30 milliseconds for the main mechanism. In the exemplary embodiment, it is contemplated that the main mechanism will move to the open position after the blow-open position is reached, allowing the other poles associated with the circuit breaker to open.

Further, the level at which the blow-open operation is activated is a function of the force generated by the springs 64, 88, 102, 104. The operator may choose the level at which the circuit breaker 20 will initiate the blow-open operation by changing the springs 64, 88, 102, 104. Thus, a single circuit breaker may be easily reconfigured for use in many different applications through the changing of a single component. For example, the operator may desire for other circuit breakers (not shown) that are down stream from the circuit breaker 20 to interrupt the electrical current in the event of a short-circuit condition. This may be accomplished by coordinating the blow-open level of circuit breaker 20 with those down-stream circuit breakers. By utilizing this approach, the operator can provide the appropriate levels of protection to portions of the protected load, and while still maintaining protection in the event of a larger short-circuit condition.

Figure 10:
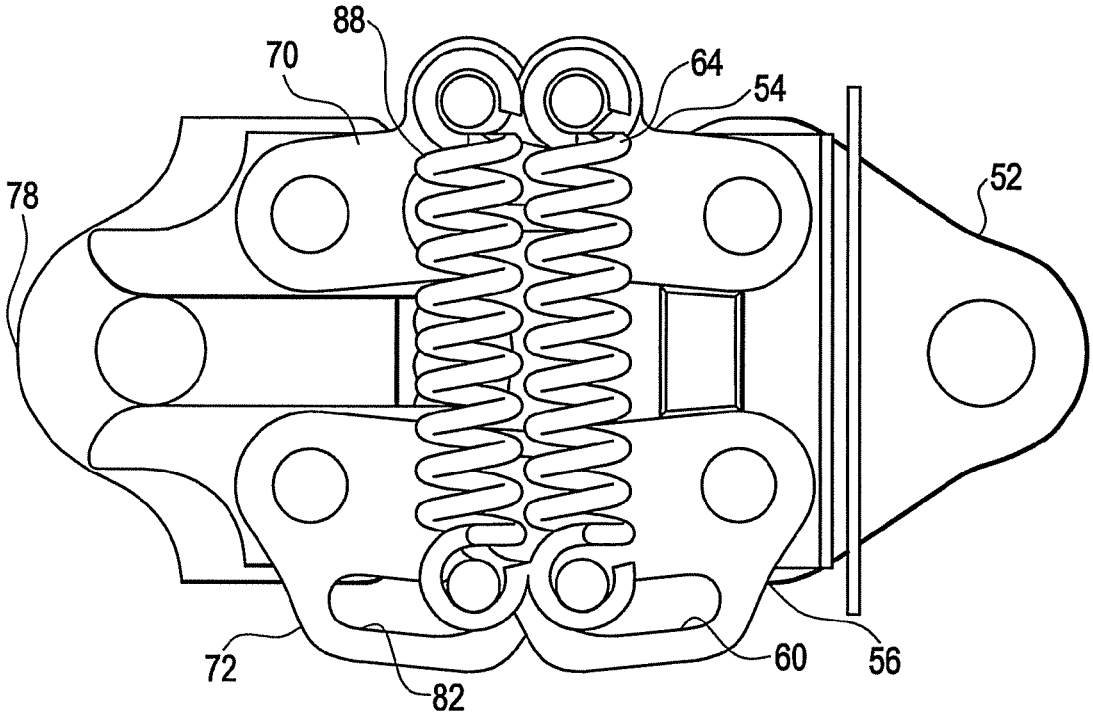
FIG. 10 is a side plan view illustration an alternate embodiment contact arm mechanism.
Figure 11:
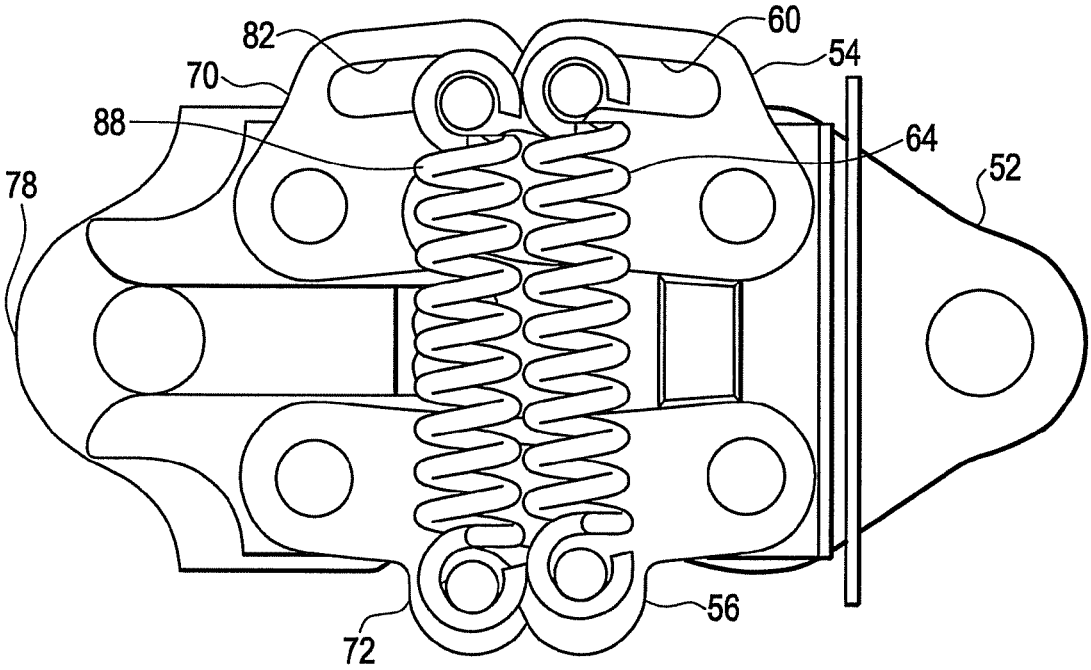
FIG. 11 is a side plan view illustration of an alternate embodiment contact arm mechanism.
Figure 12:
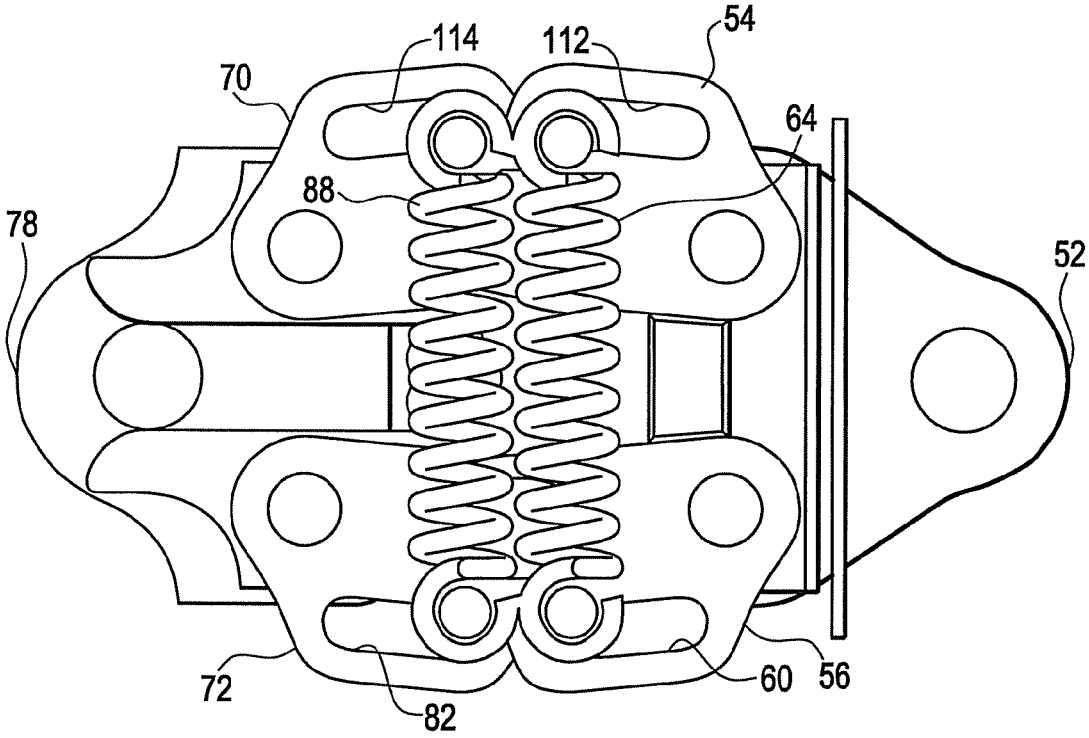
FIG. 12 is a side plan view illustration of an alternate embodiment contact arm mechanism.
Figure 13:
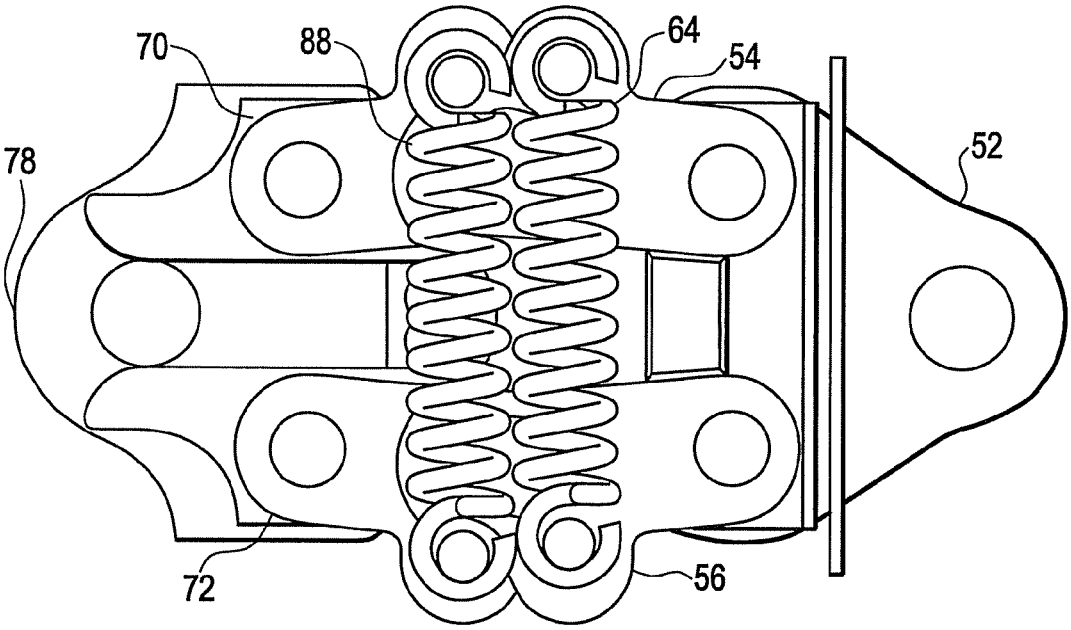
FIG. 13 is a side plan view illustration an alternate embodiment contact arm mechanism.

While the exemplary embodiment described the operation of the contact arm mechanism 24 with respect to each spring 64, 88, 102, 104 interacting with one slot, other arrangements may be used. Other contemplated alternative embodiments of the contact arm mechanism 24 are shown in FIGS. 10-13. In FIG. 10 and FIG. 11, the slots 60, 82 are located on the same side to each other of the contact arm mechanism 24. In FIG. 12, each of the links 54, 60, 70, 72 includes a slot. Finally, an arrangement that does not use slots in the links is illustrated in FIG. 13. Here, once the spring force over-centers, the links rotate away from each other until the extension springs reach an uncompressed state.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A circuit breaker comprising:

a contact structure movable between a closed and an open position;

a first mechanism operably coupled to said contact structure, said first mechanism movable between an open and a closed position;

a second mechanism operably coupled between said first mechanism and said contact structure, said second mechanism including:

a first linkage pair having first and second links operably coupled to said contact structure;

a second linkage pair having third and fourth links operably coupled to to said first mechanism;

a first spring coupling said first linkage pair; and a second spring coupling said second linkage pair.

2. The circuit breaker of claim 1 wherein said first link includes a slot, and said first linkage pair is operably coupled to said second linkage pair through said first slot in said first link.

3. The circuit breaker of claim 2 wherein said first spring is coupled to said first link through a first pin in said first link slot.

4. The circuit breaker of claim 3 wherein said third link includes a surface, said surface in contact with said first pin.

5. The circuit breaker of claim 4 wherein said first pin is translatable in said slot by said surface in response to said contact structure being moved to said open position while said first mechanism is in the closed position.

6. The circuit breaker of claim 5 further comprising:

a third linkage pair having a fifth and sixth links operably coupled to said contact structure; and, a fourth linkage pair having a seventh and eighth links operably coupled to said first mechanism.

7. The circuit breaker of claim 6 further comprising said first pin coupling to said first link and said fifth link; and a second pin coupled to said fourth link and said eighth link.

8. The circuit breaker of claim 7 further comprising a projection coupled to said contact structure and arranged between said first and second links.

9. A mechanism for a circuit breaker contact arm comprising:

a first carrier;

a first pair of linkages coupled to each other by a first spring, each of said first pair of linkages being pivotally coupled to said first carrier;

a second pair of linkages coupled to each other by a second spring, each of said second pair of linkages being pivotally coupled to said first pair of linkages; and, a second carrier pivotally coupled to said second pair of linkages.

10. The mechanism for a circuit breaker contact arm of claim 9 further comprising:

a projection coupled to said first carrier and arranged in between linkages of said first pair of linkages.

11. The mechanism for a circuit breaker contact arm of claim 10 further comprising:

a third pair of linkages pivotally coupled to said first carrier adjacent said first pair of linkages, said third pair of linkages being coupled to each other by a third spring; and, a fourth pair of linkages pivotally coupled to said second carrier adjacent said second pair of linkages, said third pair of linkages being coupled to each other by a fourth spring.

12. The mechanism for a circuit breaker contact arm of claim 11 wherein each pair of said first, second, third and fourth pair of linkages includes at least one slot.

13. The mechanism for a circuit breaker contact arm of claim 12 further comprising a first pin coupled to said first spring and said third spring, said first pin being oriented in said slot associated with said first pair of linkages and said slot associated with said third pair of linkages.

14. The mechanism for a circuit breaker contact arm of claim 13 further comprising a second pin coupled to said second spring and said fourth spring, said second pin being oriented in said slot associated with said second pair of linkages and said slot associated with said third pair of linkages.

15. The mechanism for a circuit breaker contact arm of claim 14 wherein said first pair of linkages includes a surface in contact with said second pin.

16. A multi-pole circuit breaker comprising:

a mechanism movable between a first and second position;

a first and second contact arm, said contact arms being movable between a closed and a blown-open position;

first and second contact mechanisms, each contact mechanism associated with one of said contact arms and operably coupling said associated contact arm and said mechanism, each of said contact mechanisms including:

a first carrier connected to said contact arm;

a first pair of linkages coupled to each other by a first spring, each of said first pair of linkages being pivotally coupled to said first carrier;

a second pair of linkages coupled to each other by a second spring, each of said second pair of linkages being pivotally coupled to said first pair of linkages; and, a second carrier pivotally coupled to said second pair of linkages, said second carrier being pivotally coupled to said mechanism.

17. The multi-pole circuit breaker of claim 16 wherein said first pair of linkages includes a first link having a slot and a second link wherein said first spring is coupled to said first link by a first pin slidably mounted within said first link slot to move between a locked position and an open position.

18. The multi-pole circuit breaker of claim 17 wherein said second pair of linkages includes a third link having a slot and a fourth link wherein said second spring is coupled to said third link by a second pin slidably mounted within said third link slot to move between a locked position and an open position.

19. The multi-pole circuit breaker of claim 18 wherein said third link includes a surface in contact with said first pin.

20. The multi-pole circuit breaker of claim 19 wherein said first and second pin are moveable from said locked position to said open position in response to said contact arm moving from said closed to said blown-open position and said mechanism remaining in a closed position.

* * * * *